United States Patent [19]

Andersson

[11] 4,014,358

[45] Mar. 29, 1977

[54] LOADING AND UNLOADING OF COMBUSTIBLE LIQUIDS ON, AND FROM TANKER SHIPS

[76] Inventor: Louis Andersson, Gatgatan 73 IV, S-116 72 Stockholm, Sweden

[22] Filed: July 11, 1975

[21] Appl. No.: 595,029

Related U.S. Application Data

[63] Continuation of Ser. No. 431,873, Jan. 9, 1974, abandoned.

[52] U.S. Cl. ..... 137/1; 137/154; 114/74 R

[51] Int. Cl.[2] ..... B63B 25/08

[58] Field of Search ..... 137/1, 154; 114/121, 114/74 R; 61/.5, 46.5

[56] References Cited

UNITED STATES PATENTS

| | | | |
|---|---|---|---|
| 3,491,540 | 1/1970 | Lennemann | 61/.5 |
| 3,757,813 | 9/1973 | Levenberg | 137/172 |

*Primary Examiner*—Alan Cohan
*Attorney, Agent, or Firm*—Gordon W. Hueschen

[57] ABSTRACT

To load oil on tankers in which the tank holds are previously filled with water, for ballast, and to avoid the formation of explosive vapors, oil is introduced at a higher pressure level into the tank hold than the pressure required to displace the water, while, simultaneously, the water is drawn off, by pumps or syphon action; preferably, the oil is introduced into the tanker from a level above that of the highest point of the tanker level, and water is drawn out from the bottom of the tank hold to a storage reservoir having its highest point below the lowest of the tank holds of the tanker. To unload the oil, oil is withdrawn from the top of the tanker hold into a receptacle below the level of the bottom of the tanker hold, and replaced by water introduced into the bottom of the tanker hold from a level above that of the tanker hold, withdrawal and introduction of fluids into the tanker hold being carried out simultaneously.

2 Claims, 3 Drawing Figures

LOADING OF OIL

LOADING AND UNLOADING OF COMBUSTIBLE LIQUIDS ON, AND FROM TANKER SHIPS

This is a continuation of application Ser. No. 431,873, filed Jan. 9, 1974, now abandoned.

The invention relates to loading an unloading of liquid fuels, such as crude oil, from tanker ships.

Several explosions have so far occurred with large tankers which damaged the tankers to such an extent that extensive repairs were required or that the tankers completely sank into the sea. These explosions invariably occurred at times the ship's tanks were empty, due to the presence of an explosive air-fuel mixture formed after the preceeding oil transport run. A mixture of this kind becomes dangerous of exploding only if ignited by a spark. Unexpected explosions occurred, and extensive studies have been made so far to try to determine how such explosions are triggered. Probably the sparks result from generated static electricity. As a result of these unexplained tanker explosions, the insurance premiums on such ships transporting fuel have mounted considerably.

It is an object of the present invention to improve the safety of tankers and prevent the formation of an explosive fuel-air mixture in tankers' holds.

Subject matter of the present invention: Briefly, to unload fuel, the liquid fuels are withdrawn from the upper part of the ship's tanks while, simultaneously, fresh water is fed from below to the same ship tanks; to load fuel, fuel is fed to the upper part of the tanks with slightly elevated pressure while, simultaneously, water in the tanks is withdrawn from below.

In accordance with a feature of the invention, for unloading fuel, the port facility is provided with water tanks located above the level of the tankers and with oil tanks located below the level of the tankers, connectable to the tankers with separate conduits for feeding fresh water and for withdrawing liquid fuel; for loading fuel, oil tanks are located above the level of the tanker, and water tanks therebelow.

The invention will be described by way of example with reference to the accompanying drawings, wherein.

Figure 1:
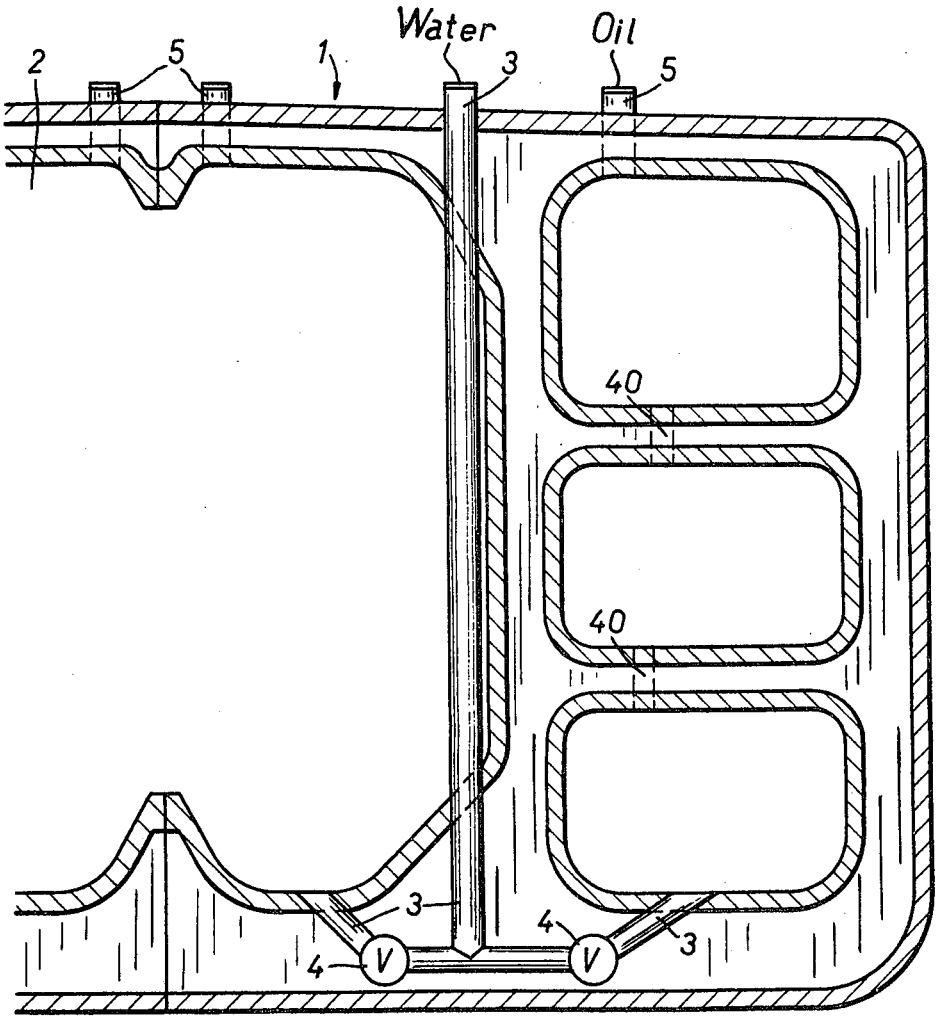
FIG. 1 shows, highly schematically, a partial cross section of a tanker.

Tankers 1 (FIG. 1) usually contain several ship tanks 2 subdivided by vertical walls. The subdivisions include central tanks and lateral tanks vertically connected as shown by pipes 40. A conduit 3 which may be opened or closed by means of valves 4 opens into the bottom of each of said tanks.

Figure 2:
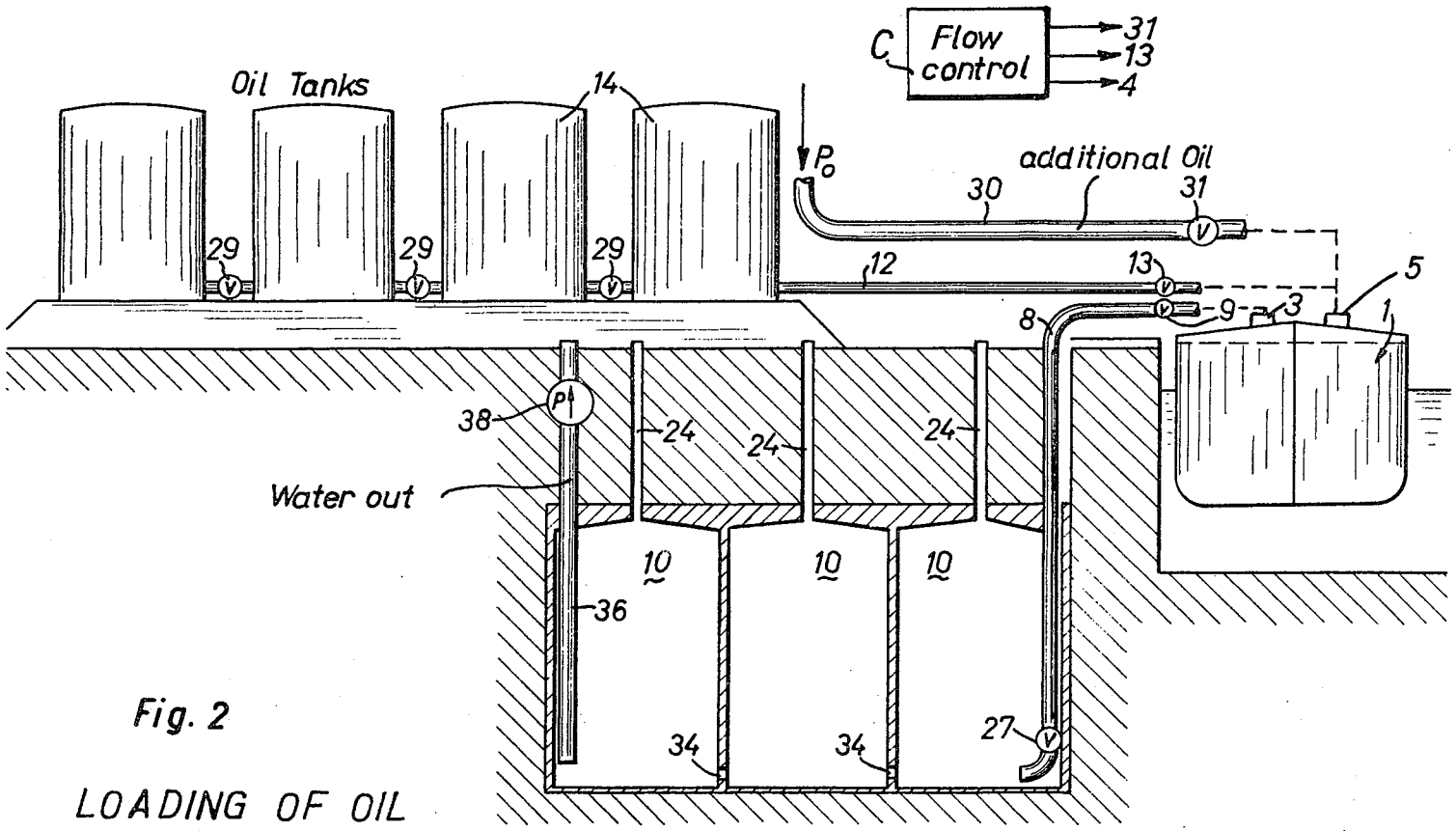
FIG. 2 shows a part sectional, part pictorial view of the port facility for loading a tanker with liquid fuel and for unloading water.

The port facility shown in FIG. 2 is provided with fittings which can be connected with the conduits 3 and 5 of the tankers. If a tanker 1 is stationed in an oil loading port, as shown in FIG. 2, the conduit 3 is connected with a water conduit 8, by way of a closable valve 9, as schematically shown in dashed lines. This water conduit opens into at least one water tank 10 located below the bottom of the tanker 1.

The conduit 5 of the tanker 1 is connected (shown schematically in dashed lines) to an oil supply conduit 12 by way of closable valve 13. This supply conduit 12 is in communication with the oil storage tanks 14, interconnected by conduits and valves 29, in which the liquid fuel meant to be transported, in particular crude oil, is stored. The deepest point of the storage tanks 14 lies above the top of the ship tanks 2. Additional oil can be supplied under some overpressure through line 30, under control of valve 31.

Let it be assumed that the tanker 1 contains a load of fresh water which is to be unloaded, in place of which crude oil or a similar fuel is to be loaded. To this end the two valves 9, 13 are opened, subsequent to establishing the conduit connection. The slight excess pressure of the crude oil flowing through the conduit 12 into the ship tanks 2 from above results in a displacement of the water present in the ship tanks by way of the conduit 8. As soon as this conduit is completely filled with water, the syphon effect makes itself felt, the water flows by virtue of said effect into the water tanks 10, and at the same time an equal volume of liquid fuel flows into the ship tanks 2. Since the liquid fuel invariably has a lower specific weight than water, the water invariably lies below and the liquid fuel above. Since air is absent to a great extent and flow can be controlled to present virtually no turbulence, there practically does not occur any intermixing of the two liquids. Water tanks 10, communicating at the bottom at 34, are vented at 24; a drain pipe 36 with a pump 38 is provided to empty the tanks and supply the water to a suitable purification plant, for example for cleaning, and re-cycling, e.g. for agriculture, industrial or sanitary use.

Figure 3:
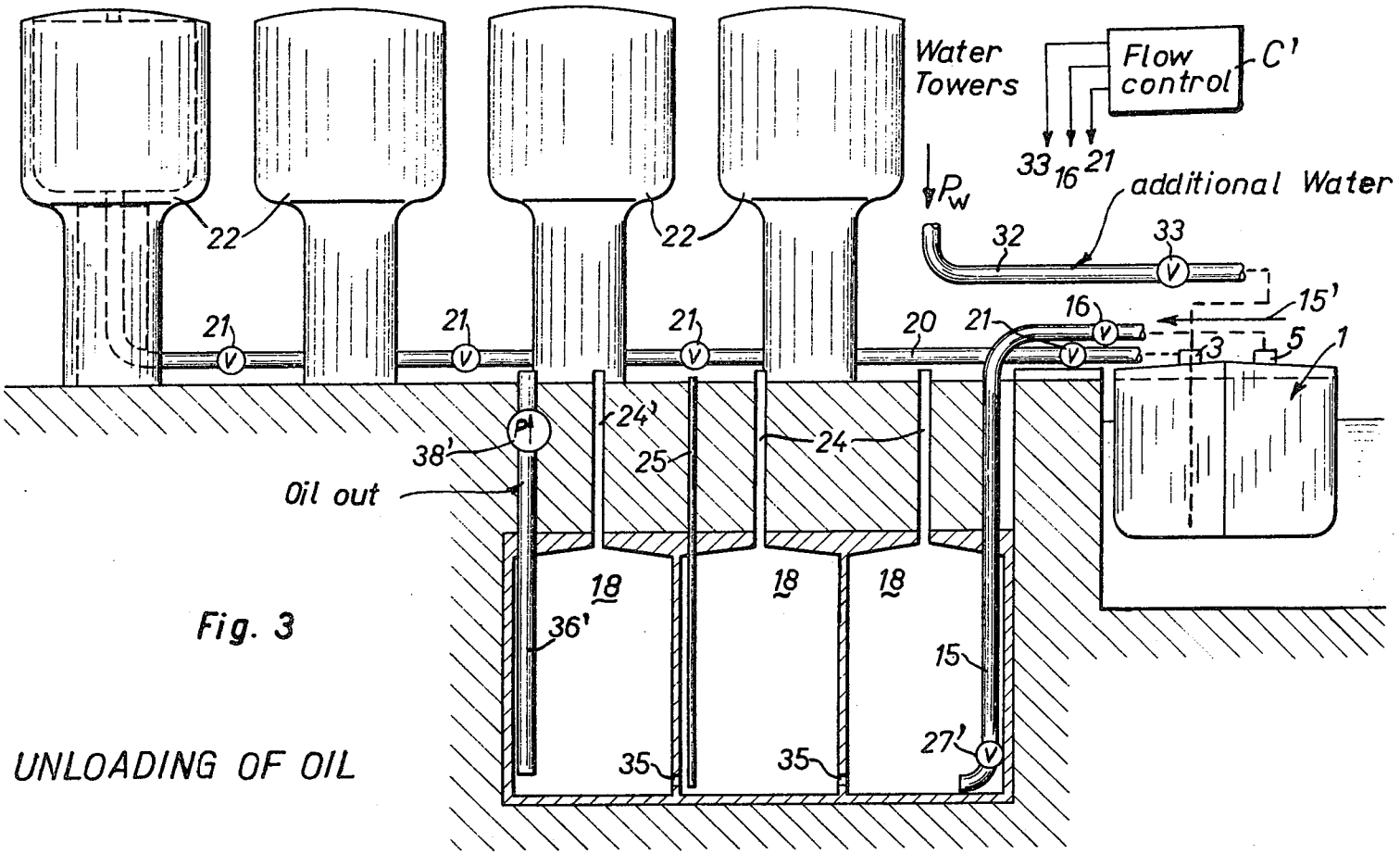
FIG. 3 shows a schematic view of the port facility for unloading liquid fuel and for loading water.

When the tanker 1 is fully loaded in this manner with crude oil or with a similar liquid fuel, the valves 9, 13 are closed and the conduit connections severed. The tanker 1 may then travel to a port for unloading oil, as shown in FIG. 3, where the oil is unloaded and at the same time fresh water is fed in its place into the ship tanks 2. The fuel conduit 5 is now connected with the conduit 15, in which there is provided a closable valve 16. This conduit 15 opens into the oil tanks 18 located at the bottom of the port facility, and lower than the tanker bottom and communicating via openings 35. The water conduit 3 of the tanker 1 is connected with a conduit 20 in which there are provided the closing valves 21. The conduit 20 is in communication with several water towers 22 containing fresh water, so that after opening the proper valves the water flows from below due to its own weight into the ship tanks 2 and displaces, at the same time, the fuel contained therein in upward direction, so that the fuel flows into the oil tanks 18 by way of the conduits 5 and 15. The water towers 22 are located at a higher level than the tanker 1. Additional water can be supplied, under some overpressure, through line 32, under control of valve 33. The low oil tanks 18 are provided with de-aeration or vent conduits 24'. Closable valves 27, 27' are provided at the lower end of the conduits 8 and 15, respectively, to prevent a complete emptying thereof and facilitate the occurrence of the syphon effect.

Risers 25 (only one shown in FIG. 3) are provided in the oil tanks 18. They extend nearly as far as the tank bottom, to drain off any water-oil mixtures or other heavier-than-oil residues from the inside of the oil tank, by connection to suitable pumps, not shown.

The liquid fuel is unloaded in this manner from the tanker 1 by using the syphon effect, it necessary assisted by pumping, in the direction of arrows 15', FIG. 3, and at the same time fresh water is fed into the ship's tanks 2. A given volume of water weighs more than the same volume of fuel. At the end of the unloading sequence, the ship's tanks therefore are not filled completely with water, but only to about ⅔ of their capacity. However, during unloading, each single tank is first completely filled with water and made to overflow, so as to wash out all fuel residues. Thereafter, a portion of the water is drained off or transferred into other tanks in the tanker's hold until the desired loaded weight of the tanker is reached.

Thus, to unload oil from the tank holds of a tanker and load ballast water, for the simultaneous withdrawal of oil and introduction of water, the oil is withdrawn from the upper level of the tank hold while simultaneously introducing water at the lower level of the tank hold, and the introduction step comprises the sequence of first filling a tank hold of the tanker ship completely with water. Subsequently to filling one tank hold of the tanker with water, a portion of the water in the one tank hold is transferred from that tank hold into a second tank hold and further water is added until the second tank hold is completely filled with water. The steps of completely filling a tank hold with water and then partially withdrawing water from the tank hold are repeated with subsequent tank holds, until all of the tank holds are at least partially filled with water. The oil is pumped to oil storage tanks, for further transport and treatment, e.g. refining, by pumps 38' connected to pipes 36' extending into the tanks 18.

During the entire process of reloading, the oil or the liquid fuel hardly comes into contact with the air. Thus, vapors and explosive mixtures cannot form.

The inside surfaces of the ship tanks 2 are covered with a coating of oil repellent and water repellent age-hardening plastic paint which facilitates keeping the tanks clean.

The relatively insignificant oil-water emulsion which forms at the interface between the two liquids is drained separately and can be subsequently separated in special separators.

The water will have only little oil mixed therein, and, after purification for example in a settling tank, or by chemical means, can be re-used, for example for industrial, sanitary or agricultural purposes. It is not required to flush the tanks with sea water, and thus ocean pollution is avoided.

In the specification, and in the claims, reference has been made to introducing liquids (water, or oil) from a higher level, and withdrawing liquids (oil, or water, respectively) to a lower level. While these levels may be physical, as illustrated in the drawings (FIGS. 2, 3) they may also be pressure levels, as schematically illustrated by arrows $P_O$ (FIG. 2) and $P_W$ (FIG. 3), showing introduction of additional oil, or additional water, respectively, to the oil, or water inlets on the tankers 5, 3, respectively, at a higher pressure, generated, for example, by pumps (not shown). Additional oil, besides that in the oil tanks 14 (FIG. 2) can thus be introduced at a pressure level $P_O$ through pipe 30, under control of valve 31. Upon unloading of the oil, water can be introduced over water main 32, at a pressure $P_W$, under control of valve 33. Removal of water (FIG. 2) or unloading of oil (FIG. 3) can additionally be assisted by pumps placed in line (FIG. 2) or 15 (FIG. 3), respectively, not shown in the drawings, and generating a negative pressure in the respective connecting lines.

Control of the valves 9, 13, 31 (FIG. 2) is effected by a flow controller C which both regulates the pressure as well as the timing of control of flow of oil into the tanker and removal of water from the tanker, by simultaneously controlling the respective valves as schematically indicated by the lines with the arrows from the flow controller C. Likewise, unloading of oil is controlled by a flow controller C' (FIG. 3) which controls the valves 16, 21, 33 for simultaneous introduction of water into the tanker holds, while oil is withdrawn. The flow controller C', by suitable switches, for example under supervision of an operator (or automatically) in conjunction with suitable openings of the valves 4 (FIG. 1) can be used to selectively adjust the water levels in the various tank holds of the tanker to provide for uniform loading and ballasting of the tanker.

Various changes and modifications may be made within the scope of the inventive concept.

I claim:

1. Method of unloading oil from the tank holds of a tanker and replacing it with ballast water, by exchanging oil located in the tank holds of a tanker ship and water located in a storage tank on land, comprising the steps of:

simultaneously withdrawing oil from the tank hold while supplying water from said storage tank to the tank hold by removing, by differential pressure, oil from the upper level of the tank hold while simultaneously introducing water into the same tank hold at the lower level of the tank hold, the introduction of the water comprising the following sequence of steps:

a. first filling a tank hold of the tanker ship completely with water;

b. subsequent to filling that tank hold with water, transferring a portion of the water from the filled tank hold into a second tank hold and then adding more water until the second tank hold is completely filled;

repeating the steps of (a) completely filling a tank hold with water and then (b) partially withdrawing water from the filled tank hold, until all of the tank holds of the tanker have been completely filled with water and are at least partially filled with water.

2. Method of claim 1, wherein:

both said oil withdrawal and water introduction steps are carried out under essentially non-turbulent flow conditions, said introduction of water step includes the step of feeding water to the tank hold from an elevation above that of the upper level of the tank hold to displace the oil, and said withdrawal of oil step includes the step of withdrawing oil from the tank hold to a storage means located at an elevation below that of the lower level of the tank hold to completely drain the oil therefrom by creation of a siphon effect for syphoning the oil out of the tank hold, and said introduction of water is carried out at a pressure sufficient to displace the oil in said tank hold, said differential pressure and said siphon effect resulting from said difference in elevation between the said water supply tank and said oil storage tank.

* * * * *

UNITED STATES PATENT OFFICE

CERTIFICATE OF CORRECTION

Patent No. 4,014,358 Dated March 29, 1977

Inventor(s) Louis Andersson

It is certified that error appears in the above-identified patent and that said Letters Patent are hereby corrected as shown below:

Col. 3, Line 63; change "line (FIG.2)" to read --- line 8 (FIG. 2)---

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*